US009976371B2

(12) United States Patent
Castillo et al.

(10) Patent No.: US 9,976,371 B2
(45) Date of Patent: May 22, 2018

(54) PIPE CONVEYED LOGGING WHILE FISHING

(71) Applicant: Baker Hughes Incorporated, Houston, TX (US)

(72) Inventors: Homero C. Castillo, Kingwood, TX (US); James O. Rogers, Spring, TX (US); Angus J. Simpson, Spring, TX (US); Chris J. Morgan, Spring, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 454 days.

(21) Appl. No.: 14/490,094

(22) Filed: Sep. 18, 2014

(65) Prior Publication Data

US 2016/0084029 A1 Mar. 24, 2016

(51) Int. Cl.

| | |
|---|---|
| ***E21B 31/00*** | (2006.01) |
| ***E21B 23/14*** | (2006.01) |
| ***E21B 17/02*** | (2006.01) |

(52) U.S. Cl.

CPC ..... *E21B 31/00* (2013.01); *E21B 17/023* (2013.01); *E21B 17/028* (2013.01); *E21B 23/14* (2013.01)

(58) Field of Classification Search

CPC ..... E21B 17/023; E21B 17/028; E21B 23/14; E21B 31/00; E21B 31/12

See application file for complete search history.

(56) References Cited

U.S. PATENT DOCUMENTS

| | | | | |
|---|---|---|---|---|
| 3,398,392 | A * | 8/1968 | Henderson | E21B 17/028 439/201 |
| 5,389,003 | A * | 2/1995 | Van Steenwyk | E21B 17/028 439/190 |
| 5,477,921 | A * | 12/1995 | Tollefsen | E21B 17/028 166/250.13 |
| 5,927,402 | A * | 7/1999 | Benson | E21B 21/103 166/324 |
| 2004/0134667 | A1* | 7/2004 | Brewer | E21B 17/023 166/380 |
| 2004/0251027 | A1 | 12/2004 | Sonnier | |
| 2005/0230115 | A1* | 10/2005 | Rose | E21B 31/00 166/301 |

(Continued)

FOREIGN PATENT DOCUMENTS

WO 2000-060212 A1 10/2000

OTHER PUBLICATIONS

PCT International Searching Authority dated Dec. 18, 2015.

*Primary Examiner* — Robert E Fuller
*Assistant Examiner* — Christopher J Sebesta
(74) *Attorney, Agent, or Firm* — Bracewell LLP; Keith R. Derrington

(57) ABSTRACT

A method of downhole operations with a wireline deployed tool that has become stuck downhole. The wireline is selectively detached from the stuck tool, and a tubular is attached to a coupling provided with the tool. The tool is unstuck by applying upward and downward forces to the tool with the tubular. The coupling further provides communication between a line in the tubular and the downhole tool, thereby providing communication between the tool and surface. Thus, after unsticking the tool, wellbore operations can continue with the tool attached onto the tubular.

16 Claims, 5 Drawing Sheets

(56) References Cited

U.S. PATENT DOCUMENTS

| | | | | |
|---|---|---|---|---|
| 2006/0243450 | A1* | 11/2006 | Head | E21B 17/026<br>166/369 |
| 2010/0132955 | A1 | 6/2010 | Storm, Jr. | |
| 2013/0175047 | A1 | 7/2013 | Steele | |

* cited by examiner

PIPE CONVEYED LOGGING WHILE FISHING

BACKGROUND OF THE INVENTION

1. Field of Invention

The present disclosure relates to a method for using a tubular string to detach a downhole tool from a wellbore wall. More specifically, the present disclosure concerns a method of disconnecting a wireline from a downhole tool that is stuck in a wellbore, connecting a tubular string to the downhole tool, and using the string to unstick the tool from the wall and continue wellbore operations after unsticking the tool.

2. Description of Prior Art

Tools for use in a wellbore that are typically deployed on a wireline include perforating guns, nuclear imaging tools, seismic imaging tools, resistivity tools, and casing collar locators. The wireline connects to the tool via a cablehead, which is generally on the uppermost portion of the particular tool. Cableheads generally include some form of electrical connection for providing signal and/or electrical communication between the wireline and the tool.

As the wireline is a generally pliable member, wireline tools typically rely on gravity to be lowered downhole. While tractors are sometimes relied on to pull wireline tools through horizontal sections of a wellbore; tractors are usually not used unless the wellbore has highly deviated portions. Wireline tool sometimes become stuck downhole because of debris deposits between the tool and sidewalls of the wellbore, pressure differentials between the wellbore and formation, or mired in the mudcake that lines the wellbore walls. Other examples of being stuck include when the tool encounters a packed off area in the wellbore, or some other restriction. Because the force required to dislodge the downhole tool often exceeds the tensile strength of the wireline, intervention is typically required to continue wellbore operations.

Intervention to unstick a wireline deployed downhole tool is usually performed by disconnecting the wireline from the tool, and "fishing" the stuck tool from the wellbore by attaching a string of drill pipe to the downhole tool, such as with an overshot tool. After the drill pipe is coupled to the downhole tool, an axial force is applied to the string, which transfers to the attached downhole tool to overcome the sticking force. To anticipate a stuck situation, frangible links are included in most cableheads that are designed to fracture under tension before the wireline fails. Fishing operations are more difficult if an amount of wireline remains in the wellbore prior to inserting the drill pipe.

SUMMARY OF THE INVENTION

Disclosed herein is an example method of wellbore operations that includes, providing a downhole tool having a cablehead that includes a detachable portion coupled to a wireline, and a base portion coupled to the downhole tool. The downhole tool is deployed in the wellbore on the wireline, and the detachable portion is selectively detached from the base portion. A tubular string is inserted into the wellbore, where string has a lower end with an attached tubular conveyed latch assembly. The tubular string is coupled to the downhole tool by engaging the tubular conveyed latch assembly to the base portion. The wireline and detachable portion can be removed from the wellbore. In an example, the downhole tool is adhered to a sidewall of the wellbore, in this case the method further includes detaching the downhole tool from the sidewall of the wellbore by applying a force along an axis of the tubular that is transferred to the downhole tool. Wellbore operations can further be conducted with the downhole tool while the downhole tool is coupled to the end of the tubular. In an example where the wireline includes a first wireline, the method further includes providing a second wireline in the tubular that is in communication with a surface above the wellbore and connecting the second wireline to the base portion so that the downhole tool is in communication with surface. Signals can be sent through the second wireline for controlling the downhole tool. Selectively detaching the detachable portion from the base portion may include providing a signal to the wireline that is transmitted to a latch assembly in the cablehead and commands the latch assembly to detach the detachable portion from the base portion. The downhole operations may be one or more of perforating the wellbore, imaging the wellbore, or conducting an intervention in the wellbore.

Also disclosed herein is an example method of wellbore operations which includes providing a downhole tool having a cablehead on an upper end that, where the cablehead includes a detachable portion coupled with an end of a wireline, a base portion selectively coupled with the detachable portion by a latch assembly having a latch device. The downhole tool is deployed into the wellbore on the wireline, and the latch assembly in the cablehead is commanded to detach the detachable portion from the base portion so that the wireline is separated from the downhole tool. A tubular having a lower end with tubular conveyed latch assembly is provided, and the tubular conveyed latch assembly is disposed adjacent the base portion. The latch device is activated to engage the tubular conveyed latch assembly with the base portion thereby joining the tubular to the downhole tool. In an example where the wireline includes a first wireline, the method can further involve communicating between a second wireline in the tubular and the downhole tool via a wet mate connection provided between the second wireline and base portion. In an alternative when the downhole tool is stuck in the wellbore, the method may further include applying an axial force to the tubular to unstick the downhole tool, and conducting wellbore operations with the downhole tool on the end of the tubular. The tubular can be an annular member, such as a drill string, tubing, coiled tubing, or combinations thereof.

Also disclosed herein is an example of a downhole assembly for use in wellbore operations which is made up of a downhole tool; where the downhole tool includes a body and a cablehead. The cablehead has a latch assembly, a detachable portion attached to a wireline, and a base portion coupled to the body and selectively coupled to the detachable by the latch assembly. A tubular conveyed latch assembly is further included which is mounted on a lower end of a tubular and that is selectively engaged by the latch assembly to attach the downhole tool to the end of the tubular. The downhole assembly may further be equipped with a first wet mate connection in the base portion that connects with a second wet mate connection that is provided with the tubular. Dogs may optionally be included in the latch assembly that selectively couple with the detachable portion and with the tubular. The detachable portion can include a housing that covers the latch assembly when the detachable portion is coupled to the base portion. The first wet mate connection may be disposed in a housing on the base portion.

BRIEF DESCRIPTION OF DRAWINGS

Some of the features and benefits of the present invention having been stated, others will become apparent as the description proceeds when taken in conjunction with the accompanying drawings, in which.

Figure 1:
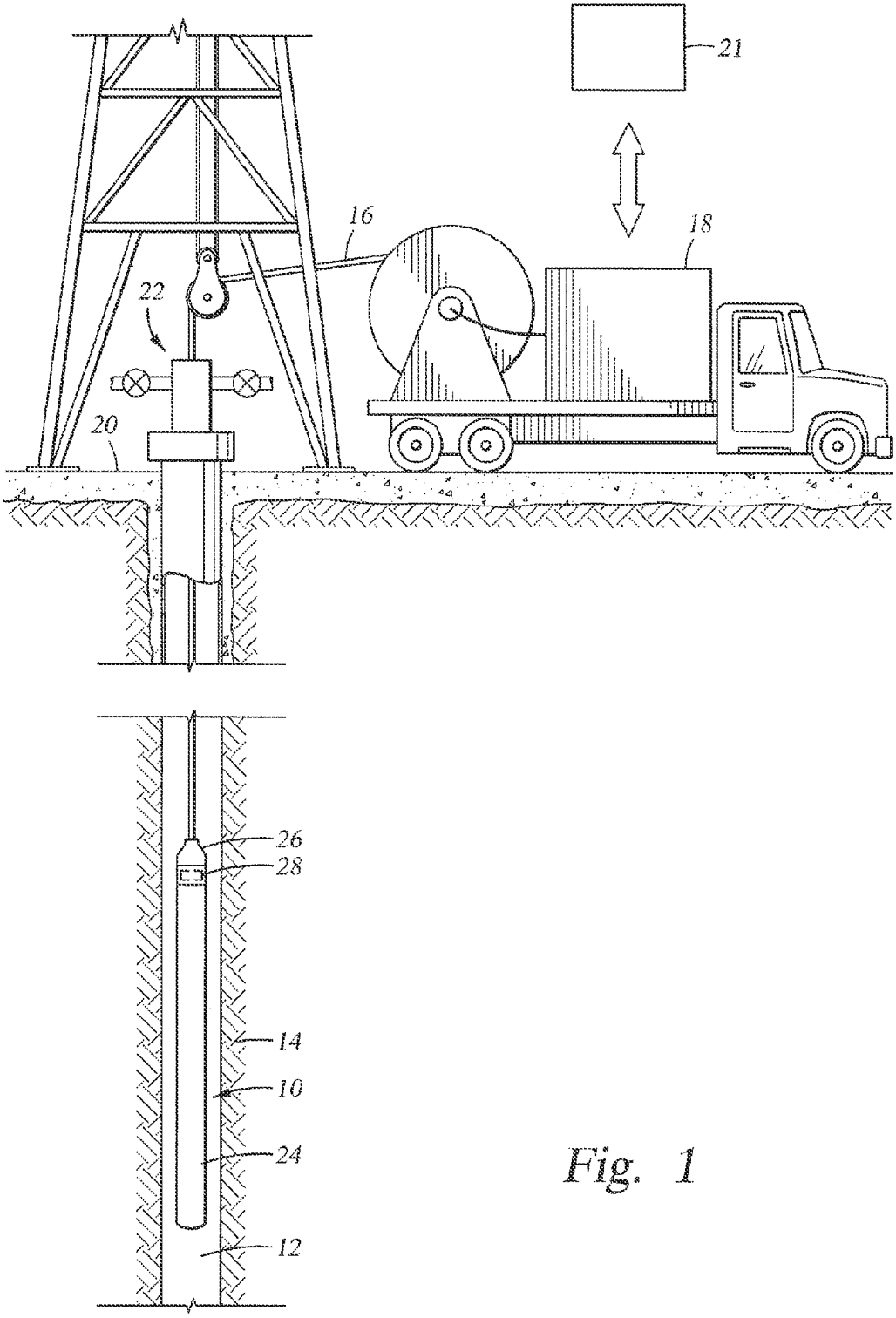
FIG. 1 is a side sectional view of an example of a downhole string with a cablehead and being deployed on a wireline in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a side sectional view of an example of a downhole string 10 disposed within a wellbore 12; where the string 10 is used for conducting wellbore operations. The wellbore 12 is shown intersecting a formation 14, which in one example contains hydrocarbon bearing strata. A wireline 16 is used for deploying the downhole string 10; an upper end of the wireline 16 is reeled from a surface truck 18 shown mounted on the surface 20 above wellbore 12. Power and communication, such as command signals, can be transmitted via wireline 16 to downhole string 10 from truck 18. Optionally, a controller 21, which can be adjacent, distal from, or in truck 18, can be included for providing communication through wireline 16. Wireline 16 is shown routed through a wellhead assembly 22 that mounts at the opening of wellbore 12 and on surface 20.

String 10 includes a downhole tool 24 that is coupled to a cablehead 26 shown on an upper end of string 10. Cablehead 26 provides electrical and mechanical connection between the string 10 and wireline 16, so that the wireline 16 can communicate to components in the string 10 via cablehead 26, and so that wireline 16 can be used to lower and raise string 10 within wellbore 12. Shown in dashed outline within cablehead 26 is a latch assembly 28 for selectively releasing string 10 from wireline 16.

Figure 2:
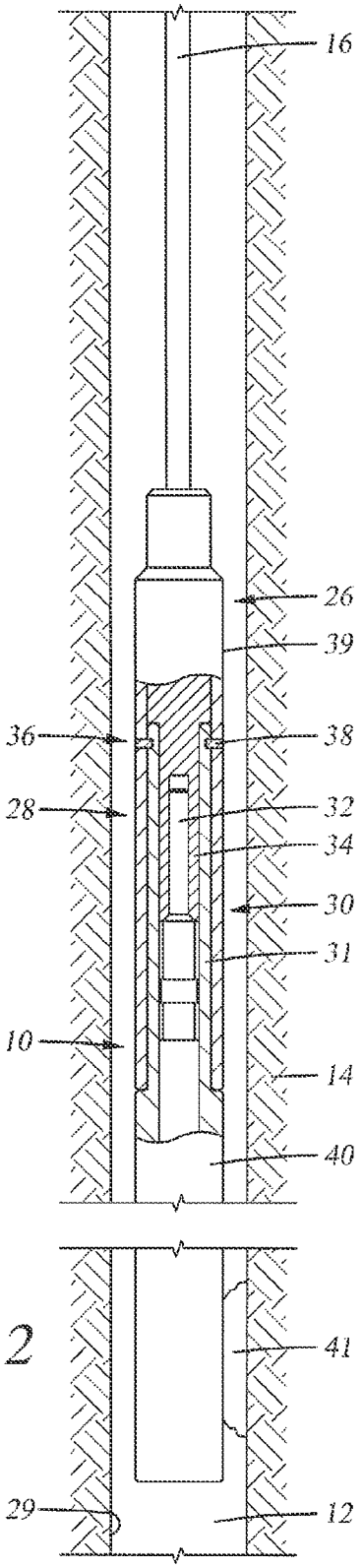
FIGS. 2 and 3 are side sectional views of the downhole string of FIG. 1 being stuck downhole, and with the cablehead being decoupled.

FIG. 2 is a side partial sectional view of the string 10 disposed in wellbore 12, and which illustrates details of the latch assembly 28. Further in the example of FIG. 2, the string 10 is shown adhered to a sidewall 29 of wellbore 12 at a location below latch assembly 28 and cablehead 26. A mating assembly 30 is shown within cablehead 26 and provides communication between wireline 16 and the portion of string 10 below latch assembly 28. A mating assembly housing 31 provides a protective covering around mating assembly 30, wherein mating assembly 30 includes a male connection 32 that inserts within a female connection 34. Male connection 32 is in communication with components within string 10, and female connection 34 is in connection with wireline 16. However, other embodiments exist wherein the location of the male and female connections 32, 34 is reversed. A latch device 36, schematically illustrated as dogs 38 that project radially outward from within an axis of tool 10, provide selective connectivity between a detachable portion 39 of cablehead 26 and a base portion 40 of cablehead 26. In one example of operation, a signal is sent through wireline 16 to latch assembly 28 for actuating the latch device 36 by decoupling the detachable and base portions 39, 40 from one another. As shown, when detached, the detachable portion 39 can be raised with the wireline 16 away from the rest of the string 10. Thus, in situations when the string 10 is adhered to the wellbore wall 29, as illustrated in FIGS. 2 through 4, and wherein the adherence force exceeds the tensile strength within wireline 16, initiating latch assembly 28 frees detachable portion 39 so it can be withdrawn from wellbore 12.

Figure 3:
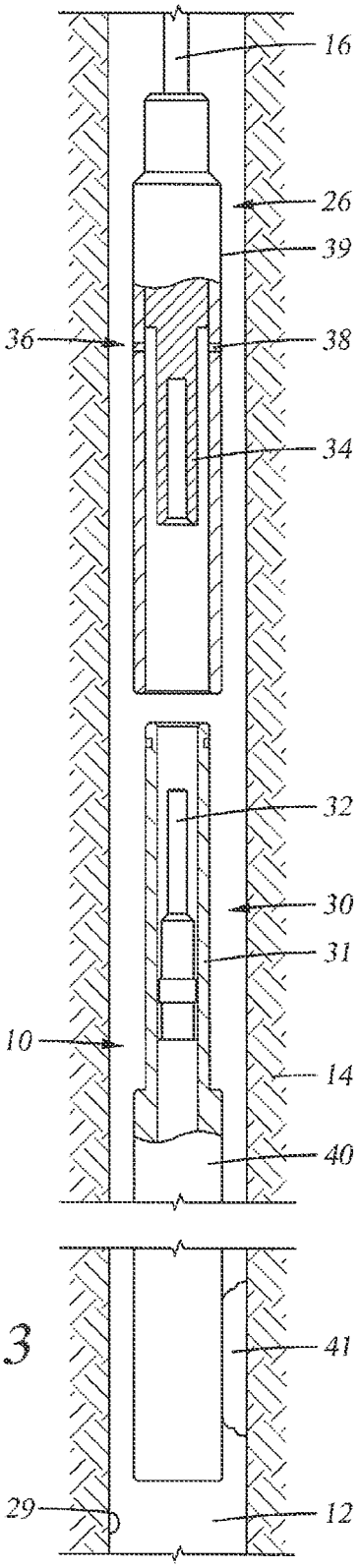
Figure 4:
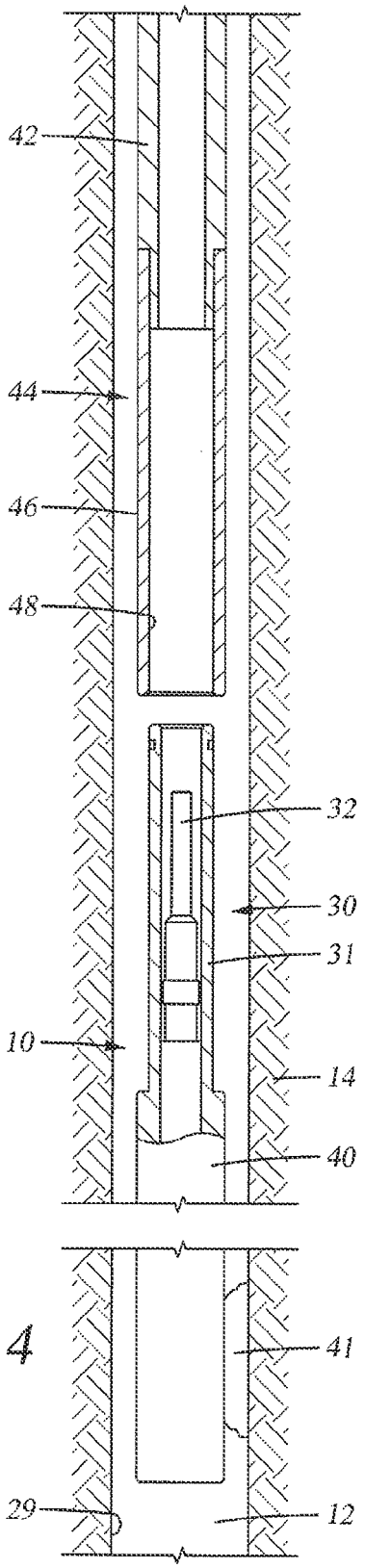
FIGS. 4-6 are side sectional views of coupling a tubular to the downhole string of FIG. 3.

Further illustrated in FIGS. 2 through 4 is an amount of bridging material 41 that is accumulated in the annular space between string 10 and wellbore wall 29 and provides the sticking force for adhering string 10 within wellbore 12. Other situations that may cause the string 10 to adhere to the wellbore wall 29 include differential pressure between wellbore 12 and formation 14, as well as becoming mired in any mudcake that may be on the wellbore wall 29.

In an example of operation, after latch assembly 28 is actuated to decouple detachable portion 39 from base portion 40, a tubular string 42 may be inserted within wellbore 12, as shown in FIG. 4, and for attaching to the base portion 40. Further illustrated in FIG. 4, the lower end of tubular string 42 is fitted with a tubular conveyed latch assembly 44 that is configured complimentarily to base portion 40, so that tubular conveyed latch assembly 44 can be mated and attached to the upper end of base portion 40. A housing 46 is shown on the outer portion of latch assembly 44; a tubular coupling 48 on the lower end of latch assembly 44 is specifically configured to mate with the upper end of base portion 40. Accordingly, the use of overshot tools and other universally adapted devices is unnecessary as the corresponding elements on the end of the latch assembly 44 and the upper portion of base portion can securely mate with one another simply by landing tubular conveyed latch assembly 44 onto base portion 40.

Figure 5:
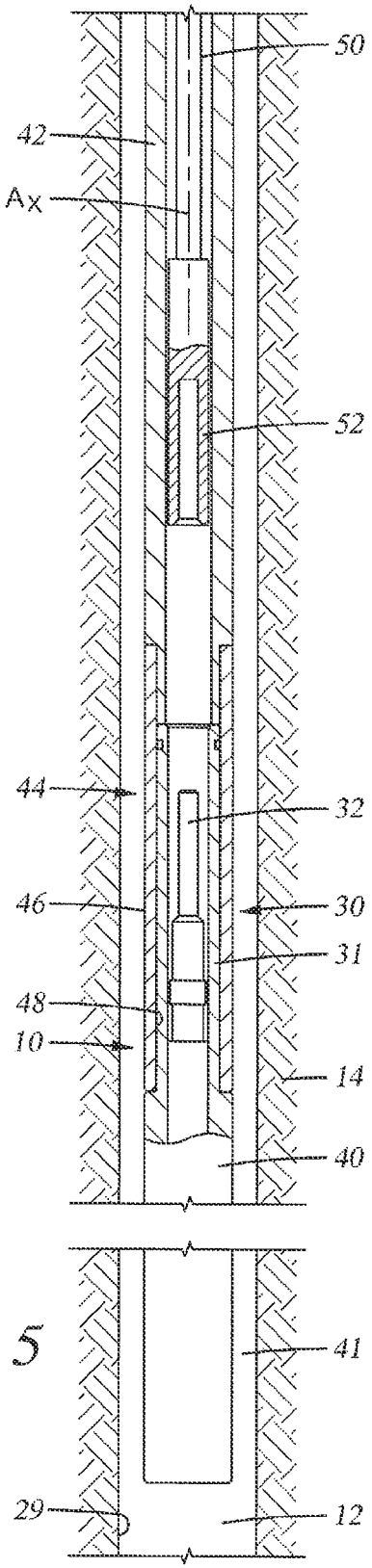
Figure 6:
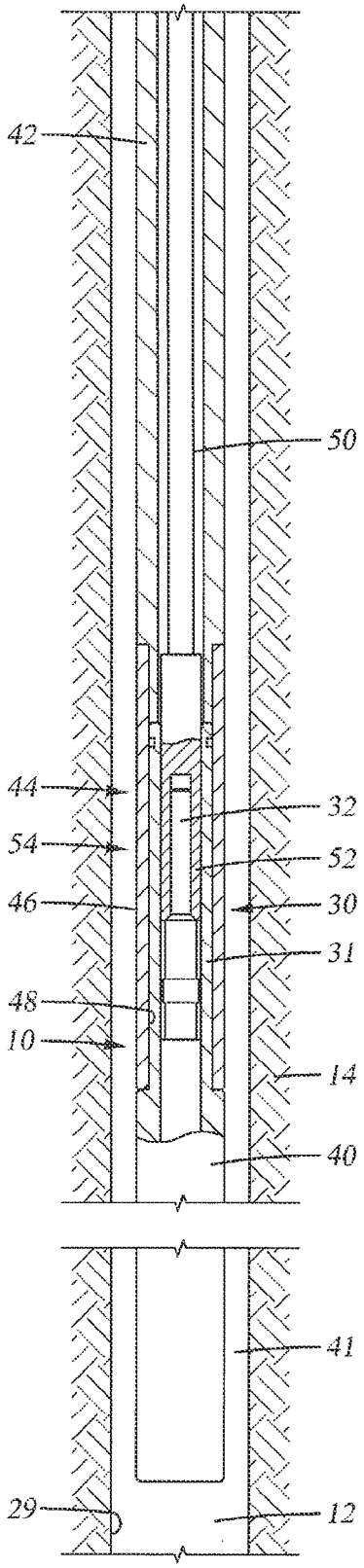

In FIG. 5, latch assembly 44 is securely coupled with base portion 40 and so that applying a axial force, such as along axis $A_X$ of string 42, can dislodge string 10 from within wellbore 12. After being dislodged, string 10 can either be removed from within wellbore 12 or additional wellbore operations can take place at the same or different depths in the wellbore 12. Further, housing 46 is shown circumscribing the mating assembly housing 31, thereby providing a covering for components within the interface between the latch assembly 44 and base portion 40. Also shown in FIG. 5 is a wireline 50 that is coaxially inserted within tubular 42, and which has a female connection 52 on its lower end. Further inserting wireline 50 down within tubular 42, as illustrated in FIG. 6, allows connection between female connection 52 and male connection 32 that is mounted within the base portion 40. In an example, connections 32, 52 are wet mate connections, so that signal communication can be made seamlessly through wireline and down to the entire wellbore or downhole string 10.

Figure 7:
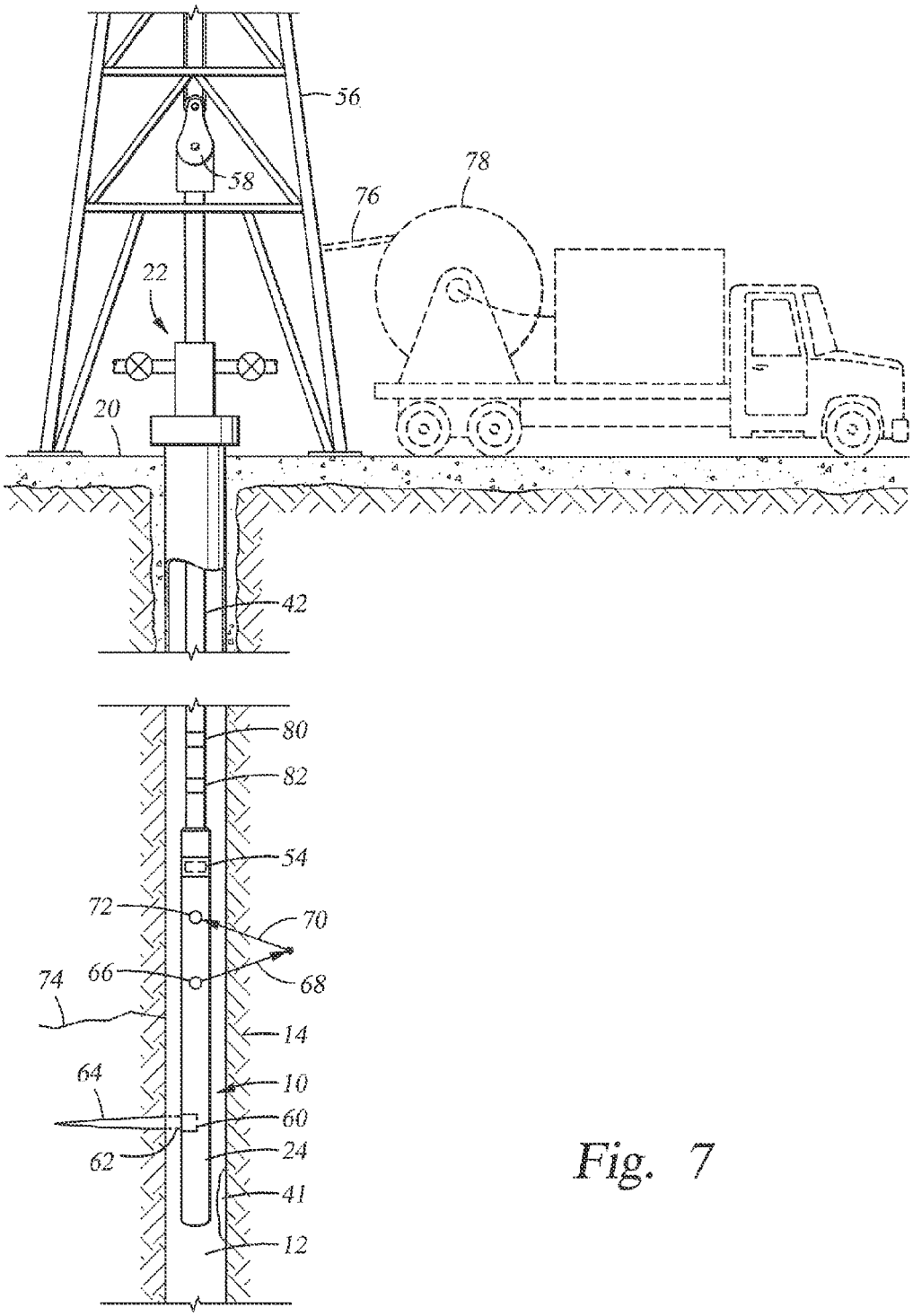
FIG. 7 is a side sectional view of an example of using the tubular of FIG. 6 to unstick the downhole string.

In the example of FIG. 7, a derrick 56 is shown that provides the upward and downward axial forces on tubular string 42 for connecting to and ultimately operating downhole string 10 within wellbore 12. Optionally, a travelling block 58 and draw works (not shown) may be used for actually applying the upward and downward axial forces onto tubular string 42. Further, the connection between connectors 32, 52 defines a latch assembly 54 that is set within housing 46. Further illustrated in FIG. 7 is one example of a wellbore operation using the downhole string 10 after the string 10 has been unstuck and moved away from the bridging material 41, or other material in wellbore 12. For example, a shaped charge 60 may be included with string 10 that when initiated forms a metal jet 62 shown projecting from the body of the tool 24 and which forms a perforation 64 within formation 14. Optionally, an imaging device can be used which includes a transmitter 66 that sends a signal 68 into formation 14. A reflected signal 70 reflects back towards tool 24 and towards a receiver 72, wherein analyzing the reflective signal 70 can provide information about the formation 14. Examples of signals 68, 70 include acoustic as well as emitted radiation that in turn scatters from the formation 14. Examples of information from the formation 14 include discontinuity 74, which can be fault lines, bed boundaries, or dipping angles. Optionally illustrated, is a length of coiled tubing 76 on a reel 78 that may be used for deploying the string 10 in lieu of the drill string 42 that is used in conjunction with rig 56.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In one example of operation, after the top of the stuck downhole string 10 along with the wireline 16 is released and removed from the wellbore 12, the tubular string 42, which includes drill pipe, is run in the wellbore 12 to engage and free the stuck downhole string 10 before the job is completed using LWD procedures. In this example, the tubular string 42 is equipped with a sub 80, which can be one or more of a power turbine sub or a pulser-telemetry sub (FIG. 7). This example can further include a fishing/latching assembly, such as the tubular conveyed latch assembly 44 of FIG. 4. In an alternate, the fishing latching assembly can include a female wet connect. In another alternative, the tubular string 42 includes drill pipe, which is run in the wellbore 12 to engage and free the stuck downhole string 10 before the job is completed using memory logging procedures. In this alternate example, the drill pipe is equipped with a module 82, which can be one or more of a battery pack or memory bank. Further, a fishing/latching assembly (including a female wet connect) can be included with this embodiment. In another alternate example, the tubular 42 includes wired drill pipe, which is run in the wellbore 12 to engage and free the stuck downhole string 10 before the job is completed using wired pipe logging procedures. In this alternate example, with wired drill pipe is equipped with module 82, which can be a power turbine (or battery pack), can be equipped with sub 80 as described above, as well as a fishing/latching assembly (including a female wet connect. These and other similar modifications will readily suggest themselves to those skilled in the art, and are intended to be encompassed within the spirit of the present invention disclosed herein and the scope of the appended claims.

What is claimed is:

1. A method of wellbore operations comprising:

providing a downhole tool having a cablehead that comprises a detachable portion coupled to a terminal end of a first wireline, a first electrical connection in the detachable portion that is in electrical communication with the first wireline, a first latch assembly, a base portion coupled on one end to the downhole tool and on another end to the detachable portion by the first latch assembly and a second electrical connection that is in selective electrical communication with the first electrical connection;

deploying the downhole tool in the wellbore on the wireline;

when a force adhering the downhole tool to a wall of the wellbore exceeds a tensile strength of the first wireline, selectively detaching the detachable portion from the base portion by activating the first latch assembly;

removing the wireline, detachable portion, and first electrical connection from the wellbore by drawing the first wireline upward;

inserting a tubular string into the wellbore having a lower end with a second latch assembly;

coupling the tubular string to the downhole tool by engaging the second latch assembly to the base portion;

inserting a second wireline having an attached third electrical connection into the tubular string; and engaging the third electrical connection with the second electrical connection to provide communication between the second wireline and the downhole tool.

2. The method of claim 1, further comprising removing all of the first wireline and detachable portion from the wellbore.

3. The method of claim 1, the method further comprising detaching the downhole tool from the sidewall of the wellbore by applying a force along an axis of the tubular that is transferred to the downhole tool.

4. The method of claim 3, further comprising conducting wellbore operations with the downhole tool while the downhole tool is coupled to the end of the tubular.

5. The method of claim 1, further comprising sending signals through the second wireline for controlling the downhole tool.

6. The method of claim 1, wherein activating the first latch assembly comprises providing a signal to the wireline that is transmitted to the first latch assembly so that dogs in the cablehead retract from engagement with the detachable portion, so that the detachable portion detaches from the base portion.

7. The method of claim 1, wherein the downhole operations are selected from the group consisting of perforating the wellbore, imaging the wellbore, and conducting an intervention in the wellbore.

8. The method of claim 1, wherein the tubular string comprises drill pipe equipped with one or more of a power turbine sub, a pulser-telemetry sub, a battery pack, a memory bank, and a fishing/latching assembly.

9. The method of claim 1, wherein the tubular string comprises wired drill pipe.

10. A method of wellbore operations comprising:

deploying a downhole tool in the wellbore on a wireline, the downhole tool comprising, a cablehead that comprises a detachable portion coupled with an end of a first wireline, a base portion selectively coupled with the detachable portion by a latch assembly having a latch device, a first electrical connection formed in the detachable portion that engages a second electrical connection in the base portion when the base portion is selectively coupled with the detachable portion, and an overshot on the detachable portion that circumscribes a portion of the base portion;

deploying the downhole tool into the wellbore on the first wireline;

releasing the detachable portion from the base portion;

disconnecting the first electrical connection from the second electrical connection by pulling the first wireline from the wellbore;

disposing a tubular having a lower end with tubular conveyed latch assembly in the wellbore and positioning the tubular so that the tubular conveyed latch assembly is adjacent the base portion;

activating the tubular conveyed latch assembly to engage the tubular conveyed latch assembly with the base portion thereby joining the tubular to the downhole tool;

inserting into the tubular a second wireline having an end with a third electrical connection; and engaging the third electrical connection with the second electrical connection so that the downhole tool is in communication with the second wireline.

11. The method of claim 10, wherein the downhole tool is stuck in the wellbore, the method further comprising applying an axial force to the tubular to unstick the downhole tool, and conducting wellbore operations with the downhole tool on the end of the tubular.

12. The method of claim 10, wherein the tubular comprises an annular member selected from the group consisting of a drill string, tubing, and coiled tubing.

13. A downhole assembly for use in wellbore operations comprising:

a downhole tool comprising a body and a base portion coupled to the body, the base portion having an elongated male connector that is substantially axial with the body;

a cablehead attached to a terminal end of a first wireline that is selectively coupled to the base portion with a first latch assembly, the cablehead comprising a detachable portion having an overshot that circumscribes the base portion and a first female connector defining a first receptacle that selectively receives the male connector; and a tubular conveyed latch assembly mounted on a lower end of a tubular that selectively engages the base portion to attach the downhole tool to the lower end of the tubular, the tubular conveyed latch assembly comprising a second female connector defining a second receptacle that receives the male connection when the tubular conveyed latch assembly engages, a base portion wet mate connector in the base portion that connects with a tubular wet mate connection that is connected to a lower terminal end of the tubular.

14. The downhole assembly of claim 13, further comprising dogs in the base portion that selectively couple with the cablehead to attach the cablehead to the tool, and that selectively couple with the lower end of the tubular to attach the tubular to the tool.

15. The downhole assembly of claim 13, wherein the cablehead comprises a housing that covers the first latch assembly when the cablehead is coupled to the base portion.

16. The downhole assembly of claim 13, wherein the first wet mate connection is disposed in a housing on the cablehead.

* * * * *